US007168908B2

(12) United States Patent
Diaz et al.

(10) Patent No.: US 7,168,908 B2
(45) Date of Patent: Jan. 30, 2007

(54) WORK TOOL COUPLING DEVICE FOR A MACHINE

(75) Inventors: Alberto Diaz, Apex, NC (US); Michael S. Sekulich, Raleigh, NC (US)

(73) Assignee: Caterpillar Inc, Peoria, IL (US)

( * ) Notice: Subject to any disclaimer, the term of this patent is extended or adjusted under 35 U.S.C. 154(b) by 44 days.

(21) Appl. No.: 11/115,571

(22) Filed: Apr. 27, 2005

(65) Prior Publication Data

US 2006/0245898 A1 Nov. 2, 2006

(51) Int. Cl.
*E02F 3/36* (2006.01)

(52) U.S. Cl. ..... 414/723; 37/468; 403/324

(58) Field of Classification Search ..... 414/723, 414/686; 37/468; 172/272–275; 403/321, 403/324

See application file for complete search history.

(56) References Cited

U.S. PATENT DOCUMENTS

D274,251 S 6/1984 Hustveit
4,480,955 A 11/1984 Andrews et al.
4,663,866 A 5/1987 Karlsson et al.
5,088,882 A 2/1992 Lovitt, Jr.
5,107,610 A 4/1992 Fusco
5,147,173 A 9/1992 Fauber et al.
5,382,110 A 1/1995 Perotto et al.
5,494,396 A 2/1996 Geier et al.
5,890,871 A * 4/1999 Woerman ..... 414/723
2003/0215320 A1* 11/2003 Harris et al. ..... 414/723

* cited by examiner

*Primary Examiner*—Donald Underwood
(74) *Attorney, Agent, or Firm*—Michael L. Woods

(57) ABSTRACT

A coupler configured to secure a work tool to a machine is provided. In one embodiment, the coupler comprises a first bore with a first axis configured to receive a first pin, a second bore with a second axis configured to receive a second pin, and an actuator including an actuator rod. The coupler is characterized in that if the first bore receives the first pin, the first pin is configured to pivotally support the coupler to a machine linkage about the first axis and pivotally support the coupler to the work tool about the first axis. Furthermore, if the second bore receives the second pin, the second pin is configured to pivotally support the coupler to a machine boom about the second axis. The coupler is further characterized in that the rod is configured to engage the work tool and, if engaged, the rod intersects the second axis.

15 Claims, 5 Drawing Sheets

WORK TOOL COUPLING DEVICE FOR A MACHINE

TECHNICAL FIELD

This invention relates to a coupling device and, more particularly, to a coupling device that is configured to couple and uncouple a variety of work tools or implements to a linkage arrangement of a work vehicle.

BACKGROUND

Some work machines, such as a small wheel loader or backhoe loader, have a boom arrangement with a coupler pivotally attached thereto. The boom arrangement often includes a boom having a boom pivot point at an end portion of the boom for pivotally connecting a coupler to the boom. In such an arrangement, the boom pivot point often defines a horizontal axis of rotation for the coupler. Additionally, the boom arrangement may be provided with a linkage configured to rotate the coupler about this horizontal axis. In these work machines, the coupler, which is connected to the boom and linkage arrangement, provides a mechanism for coupling a variety of different work tools to the work machine.

Oftentimes, the coupler is provided with work tool connection points, wherein the work tool is attached to the coupler. These work tool connection points are usually offset a distance from the boom and linkage pivot points. These offset distances may create a mechanical disadvantage for the work machine, if the offset distances are great. If the work tool is a bucket, for example, and as the offset increases, more force is required from the boom and machine linkage to carry a constant bucket load. As the lifting capacity of the work machine decreases, the work machine productivity may also decrease.

In an effort to overcome this working disadvantage, some work machines are designed with stronger lifting arrangements and with larger power plants, which often results in increased cost to make and sell the work machine.

One example of such a coupler is disclosed in U.S. Pat. No. 5,382,110 to Perotto et al. ("Perotto"). In Perotto, a quick coupling device adapted for mounting a tool to a boom of a carrier is provided.

Further, in other work machines, the operator may need to securely attach the work tool to the work machine by manually pinning the work tool to the coupler. In these machines, productivity decreases as the operator spends more time coupling and decoupling work tools.

The present invention is directed to overcoming one or more of the problems as set forth above.

SUMMARY

In one embodiment, a coupler configured to secure a work tool to a machine is provided. The coupler comprises a first bore with a first axis configured to receive a first pin, a second bore with a second axis configured to receive a second pin, and an actuator including an actuator rod. In this embodiment, if the first pin is received by the first bore, the first pin is configured to pivotally support the coupler to a machine linkage about the first axis and pivotally support the coupler to the work tool about the first axis. Additionally, if the second bore receives the second pin, the second pin is configured to pivotally support the coupler to a machine boom about the second axis. Also in this embodiment, the actuator rod is configured to engage the work tool, and if the actuator rod engages the work tool, the actuator rod intersects the second axis.

In another embodiment, a machine is provided that comprises a machine linkage, a machine boom, and coupler as described above.

DETAILED DESCRIPTION

Figure 1:
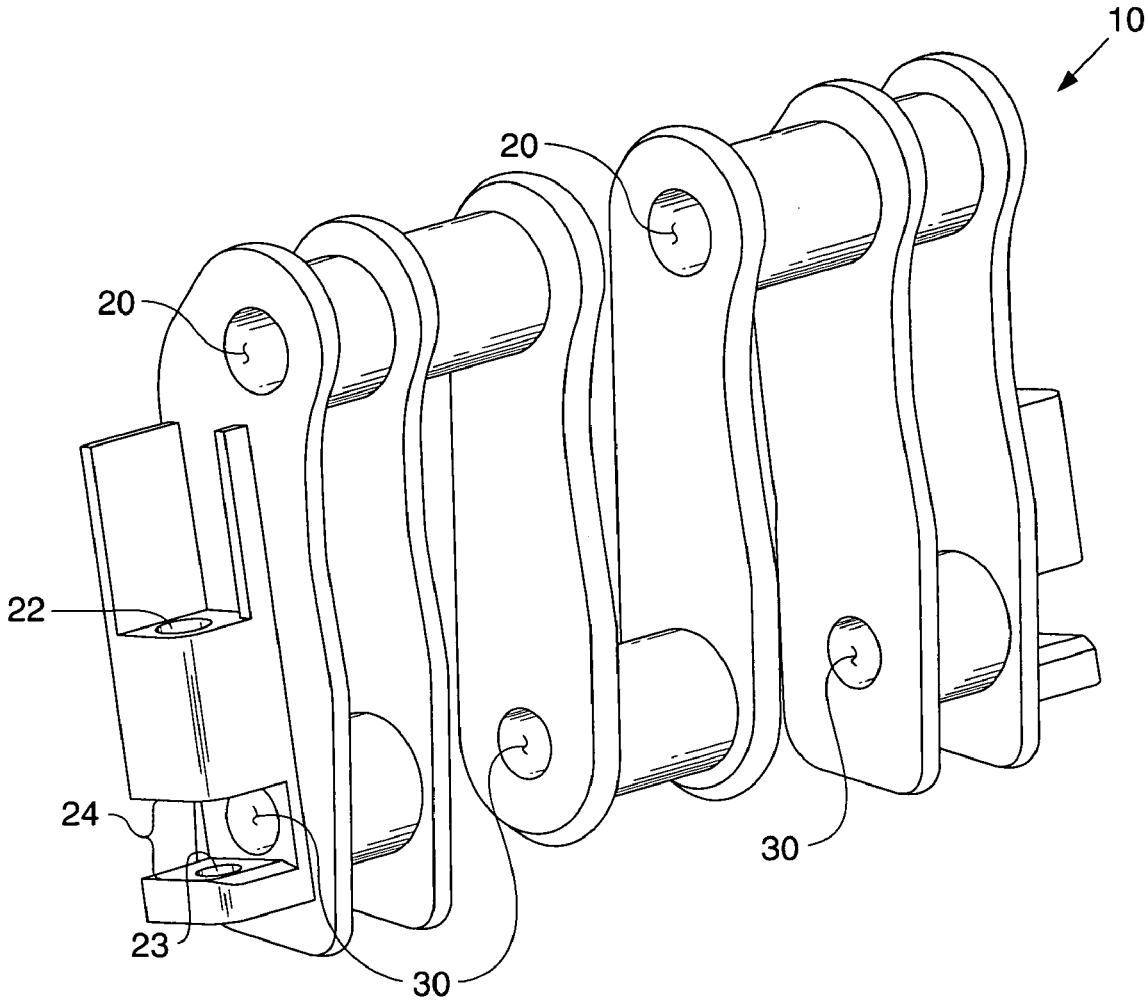
FIG. 1 is a perspective view of an exemplary embodiment of a coupler of the present description.

Referring now to the drawings, and more particularly to FIG. 1, an exemplary embodiment of a machine coupler 10 is shown. The coupler 10 may be cast, machined, or manufactured in any known way as one skilled in the art would know. In this embodiment, coupler 10 is cast from steel, with bores 20 and 30 machined after the casting.

The coupler 10 includes a first bore 20 and second bore 30. In this embodiment, both bores 20 and 30 are substantially horizontal and parallel to one another. In this particular embodiment, coupler 10 is manufactured to form the depicted web-type design. The web-type design provides for improved visibility, as the operator, if sitting in a cab of the machine, may see partially thru coupler 10 to his or her work surroundings.

Figure 2:
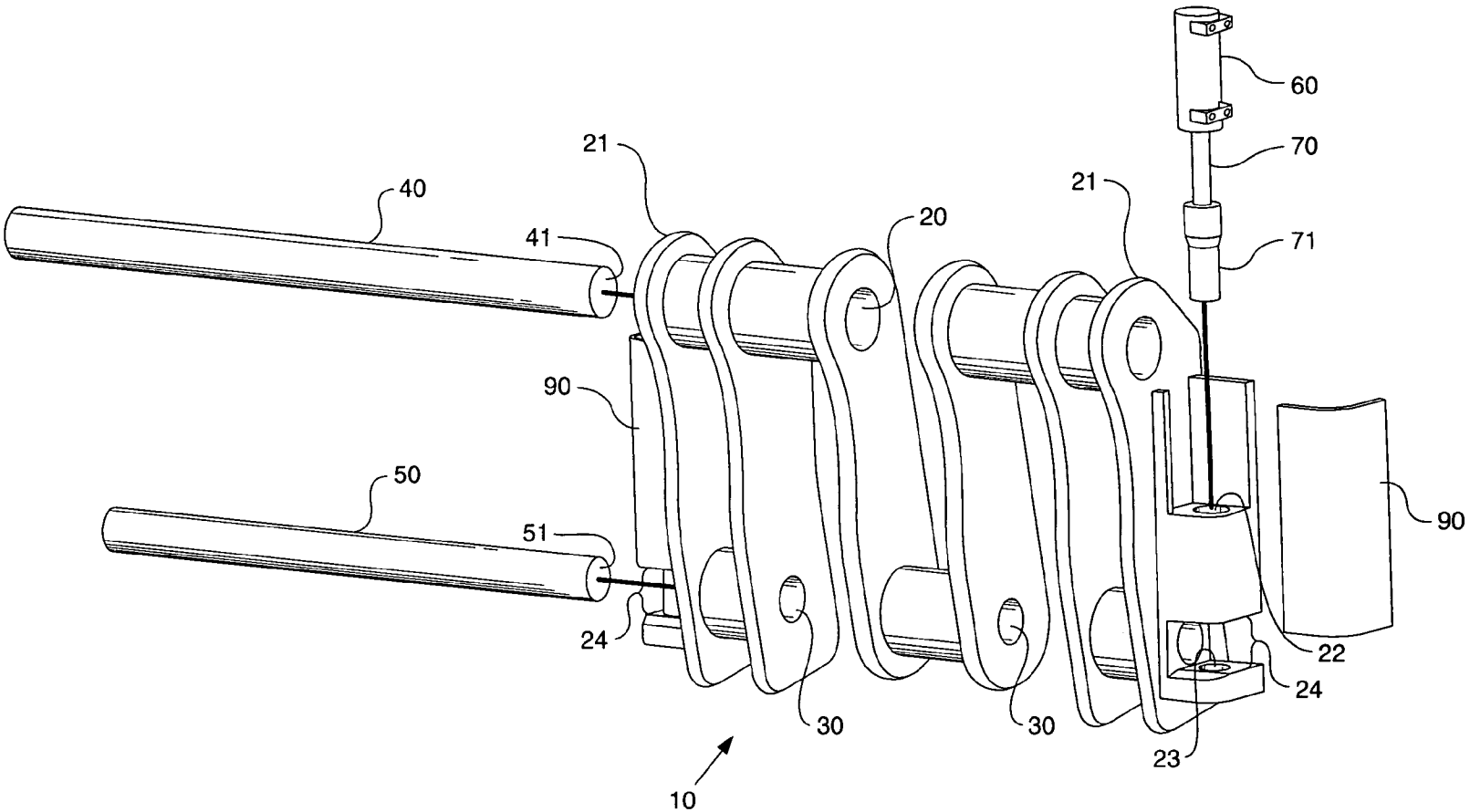
FIG. 2 is a perspective view of the coupler of FIG. 1 along with a first pin, a second pin, a cover, and actuator.

Now referring to FIG. 2, it can be seen that first bore 20 is configured to receive a first pin 40. When first pin 40 is inserted into first bore 20, first pin 40 extends beyond both ends 21 of coupler 10. By extending both ends 41 of pin 40 beyond ends 21 of coupler 10, pin 40 is configured to pivotally support a work tool 80 (depicted in FIGS. 3 and 5), which may hang via hooks 120 on work tool 80.

Figure 4:
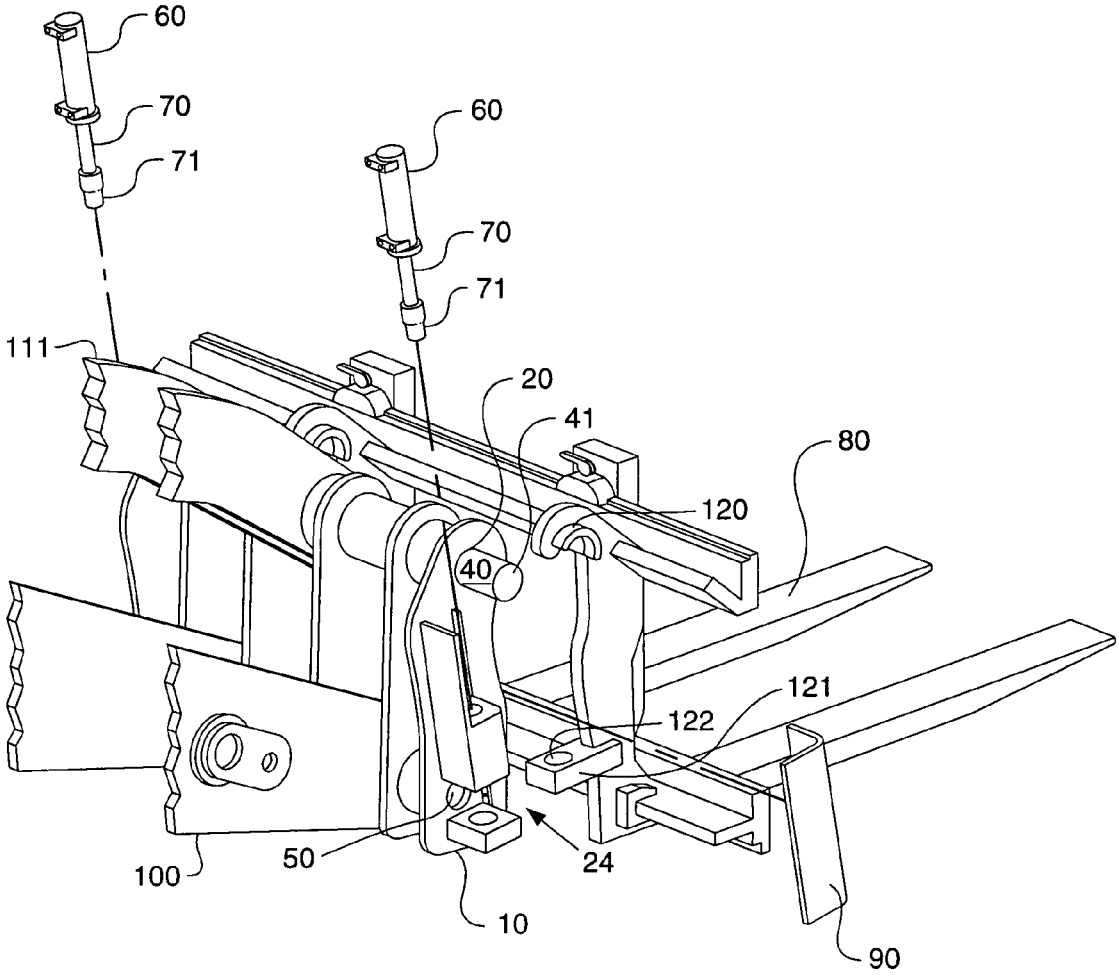
FIG. 4 is a perspective view of the coupler of FIG. 1 coupled to a machine boom and machine linkage and alongside a work implement.
Figure 5:
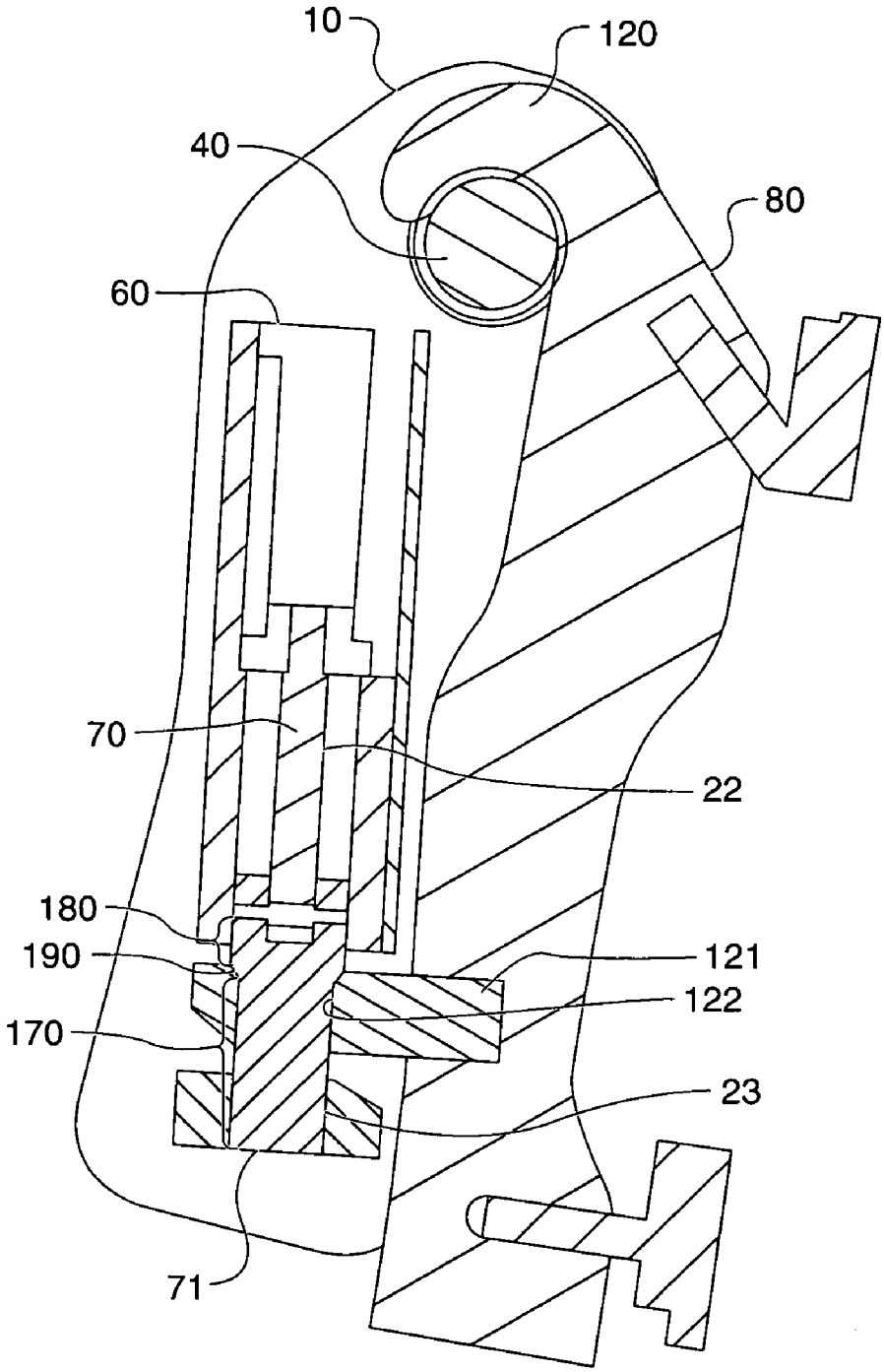
FIG. 5 is a partial cross-sectional side view of the coupler and work implement of FIG. 3.

As can also be seen in FIG. 2, coupler 10 comprises second bore 30, which is configured to receive a second pin 50. The length of second pin 50, however, is not substantially longer than the coupler 10, as is first pin 40. As such, when second pin 50 is inserted into second bore 30, ends 51 of second pin 50 do not extend substantially beyond ends 21 of coupler 10. If ends 51 of second pin 50 extended beyond ends 21 of coupler 10, ends 51 may interfere with proper insertion of work tool 80 piece 121 and engagement pin 71 of actuator 60, as depicted in FIGS. 4 and 5.

In this embodiment, coupler 10 comprises an actuator 60, which includes a rod 70 and an engagement pin 71 at one end. In this particular embodiment, a hydraulic actuator is depicted. It should be appreciated, however, that any known actuator may be used, such as a pneumatic or electric actuator. Rod 70 and engagement pin 71 are configured to be received by first aperture 22. Further, pin 71 is configured to be received by second aperture 23. First aperture 22 and second aperture 23 are substantially coaxial and define a slot 24 there between. Slot 24 is configured to receive part of a work tool 80. In operation, once coupler 10 receives work tool 80 in slot 24, engagement pin 71 of actuator 60 moves downward, as depicted in FIGS. 2 and 5, through an aperture 122 of work tool 80, so that engagement pin 71 is received by second aperture 23, thus providing positive engagement of work tool 80 to coupler 10.

As can be seen, actuator 60 rod 70 and engagement pin 71 of actuator 60 are substantially perpendicular to the axis of second bore 30. Also, when engagement pin 71 is inserted into second aperture 23, engagement pin 71 intersects the axis of second bore 30.

FIG. 2 also depicts a cover 90, which is configured to cover at least part of actuator 60 and actuator 60 rod 70 from the working environment, which may be harsh in certain construction or mining applications.

Figure 3:
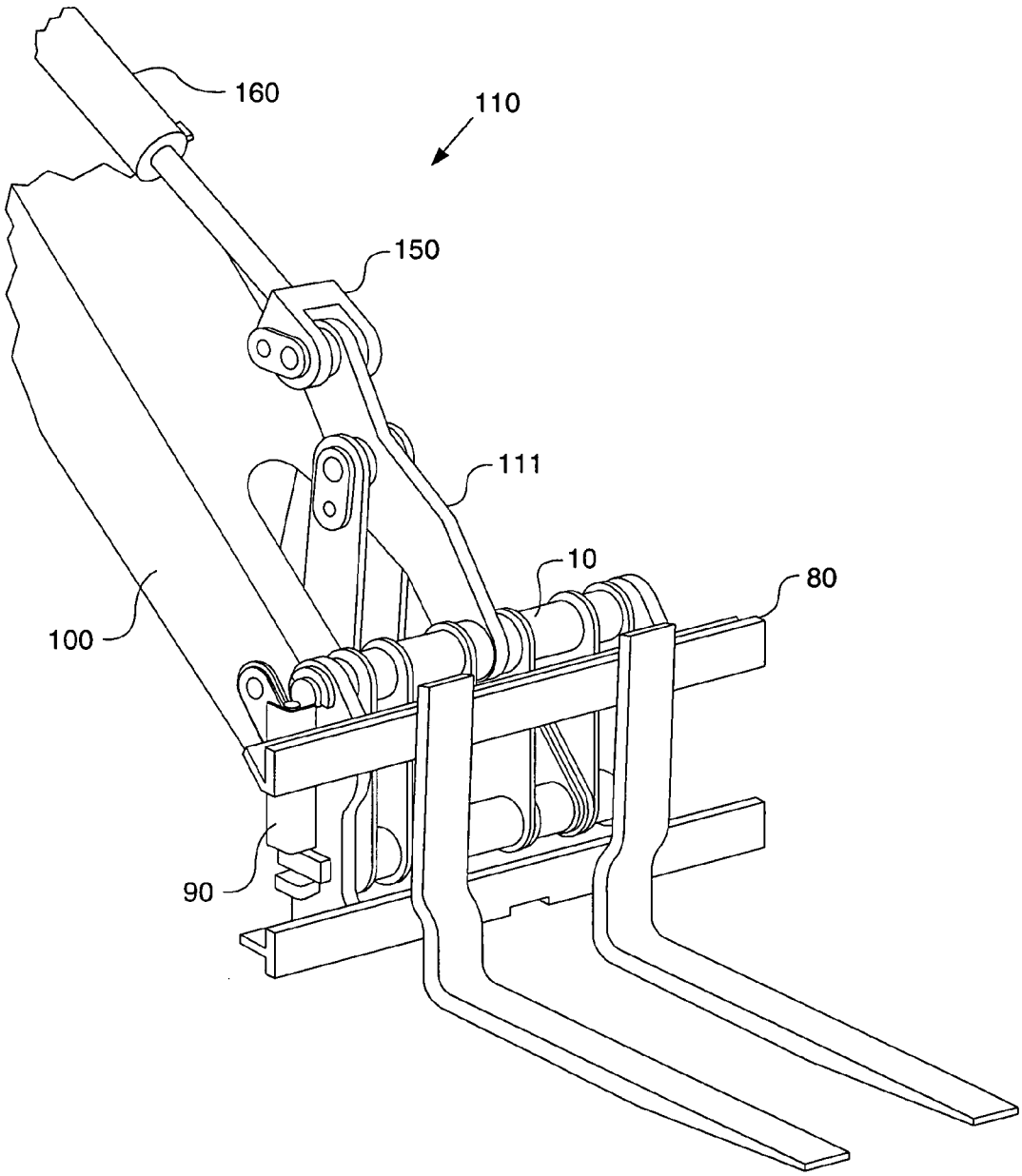
FIG. 3 is a perspective view of the coupler of FIG. 1 coupling a work implement to a machine boom and machine linkage.

Now referring to FIG. 3, FIG. 3 depicts coupler 10 of FIGS. 1 and 2 attached to part of a work machine. FIG. 3 also depicts coupler 10 attached to work tool 80, which in this depiction is a fork. The reader should appreciate that any work tool 80 may be used with this coupler 10, including a brush, a bucket, or a grappler, for example.

The part of the machine depicted includes a machine linkage 110 and a boom arrangement 100. As can be seen, machine linkage 110 includes a linkage actuator 160, which in this embodiment is a hydraulic actuator. Actuator 160 is pivotally connected to joint 150, which also pivotally connects one end of linkage arm 111. The other end of linkage arm 111 is pivotally connected to coupler 10 via first pin 40. As such, linkage arm 111 rotates about the first pin's 40 axis. When work tool 80 is connected to coupler 10 via hook 120, as depicted in FIGS. 3 and 5, there is zero offset between work tool 80 and machine linkage arm 111 about the first pin's 40 axis, as both the linkage arm 111 and work tool 80 are pivotally attached to coupler 10 along this axis.

Now referring to FIG. 4, work tool 80 can be seen alongside and unattached to coupler 10. As depicted, work tool 80 comprises hook 120 and engagement piece 121. Hook 120 is configured to pivotally hinge on first pin 40, as further depicted in FIG. 5. Engagement piece 121 is configured to fit within slot 24. Piece 121 comprises aperture 122. When piece 121 inserted into slot 24, aperture 122 is substantially co-axial with first and second coupler 10 apertures 22 and 23. Insertion of piece 121 into slot 24 enables actuator 60 to positively engage work tool 80.

Now referring to FIG. 5, it can be seen that work tool 80 is positively engaged to coupler 10. Hook 120 is pivotally connected to first pin 40 and piece 121 is inserted into slot 24, with engagement pin 71 inserted through work tool 80 aperture 122 and second aperture 23.

In the particular embodiment of FIG. 5, engagement pin 71 comprises a first portion 170, a second portion 180, and a stepped portion 190. As can be seen, the diameter of first portion 170 is smaller than the diameter of second portion 180, with stepped portion 190 providing a tapered diameter between first and second portions 170 and 180. This particular configuration allows for easy insertion of pin 71 along portion 170 into aperture 122, while ensuring positive engagement with substantially zero rattling of work tool 80 when attached to coupler 10. In this embodiment, the first portion's 170 diameter is smaller than the diameter of aperture 122 and the second portion's 180 diameter is larger than the diameter of aperture 122. This configuration allows stepped portion 190 to positively engage work tool 80, thus providing substantially no relative movement between engagement pin 71 and work tool 80 piece 121.

INDUSTRIAL APPLICABILITY

In operation, coupler 10 is pivotally attached to machine linkage 110 at linkage arm 111 via first pin 40. Additionally, coupler 10 is pivotally attached to machine boom 100 via second pin 50.

When the operator desires to couple a work implement, such as work tool 80 depicted in FIGS. 3–5, the operator will manipulate machine linkage 110 and boom 100 to position coupler 10 along side the desired work tool 80, as depicted in FIG. 2. The operator will then further manipulate coupler 10 to position first pin 40 under hooks 120 of work tool 80, and then raise coupler 10 so that hooks 120 engage pin 40. As hooks 120 are pivotally hinged to first pin 40, a zero offset (between the machine and work tool 80) at the axis of first pin 40 is provided. The operator will then slightly raise coupler 10 and move slot 24 of coupler 10 closer to work tool 80. Work tool 80 piece 121 will then move into slot 24 until aperture 122 is substantially coaxial with first and second apertures 22 and 23 of coupler 10.

Once work tool 80 hook 120 is hinged about first pin 40 at first pin 40 ends 41 and work tool 80 aperture 122 is substantially coaxial with first and second coupler 10 apertures 22 and 23, the operator will then manipulate actuator 60 so that rod 70 extends downward to positively engage engagement pin 71 to work tool 80 at aperture 122. As depicted in FIGS. 2 and 4, engagement pin 71 intersects the axis of second pin 50, thus providing zero offset at the axis of second pin 50.

Other aspects, objects and advantages of this invention can be seen from a study of the drawings, the disclosure, and the appended claims.

LIST OF ELEMENTS

TITLE: WORK TOOL COUPLING DEVICE FOR A MACHINE

FILE: 04-514

10. Coupler
20. First Bore
21. Coupler End
22. Coupler First Aperture
23. Coupler Second Aperture
24. Coupler Slot
30. Second Bore
40. First Pin
41. First Pin End
50. Second Pin
51. Second Pin End
60. Actuator
70. Actuator Rod
71. Engagement Pin
80. Work Tool
90. Cover
100. Boom
110. Linkage
111. Linkage Arm
120. Hook
121. Work Tool Piece
122. Work Tool Aperture
150. Linkage Joint
160. Linkage Actuator
170. First Portion
180. Second Portion
190. Stepped Portion

What is claimed is:

1. A coupler configured to secure a work tool to a machine, comprising:

a first bore with a first axis configured to receive a first pin, wherein if the first bore receives the first pin, the first pin is configured to pivotally support the coupler to a machine linkage about the first axis and pivotally support the coupler to the work tool about the first axis;

a second bore with a second axis configured to receive a second pin, wherein if the second bore receives the second pin, the second pin is configured to pivotally support the coupler to a machine boom about the second axis; and an actuator including an actuator rod, characterized in that the rod is configured to engage the work tool; and characterized in that if the actuator rod engages the work tool, the actuator rod intersects the second axis.

2. The coupler of claim 1, further comprising a cover configured to cover at least part of the actuator.

3. The coupler of claim 1, further characterized in that the at least one actuator rod is substantially perpendicular to the second axis.

4. The coupler of claim 1, further characterized in that the actuator is a hydraulic actuator.

5. The coupler of claim 1, further characterized in that the actuator comprises two actuator rods.

6. The coupler of claim 1, further characterized in that the actuator rod comprises an engagement pin.

7. The coupler of claim 6, further characterized in that the engagement pin comprises a tapered portion configured to engage the work tool.

8. A machine configured to be used with various work tools, comprising:

a machine linkage;

a machine boom;

a coupler, the coupler comprising:

a first bore with a first axis configured to receive a first pin, wherein if the first bore receives the first pin, the first pin is configured to pivotally support the coupler to the machine linkage about the first axis and pivotally support the coupler to the work tool about the first axis;

a second bore with a second axis configured to receive a second pin, wherein if the second bore receives the second pin, the second pin is configured to pivotally support the coupler to the machine boom about the second axis; and an actuator including an actuator rod, characterized in that the rod is configured to engage the work tool; and characterized in that if the actuator rod engages the work tool, the actuator rod intersects the second axis.

9. A coupler configured to secure a work tool to a machine, comprising:

a first bore with a first axis;

a first pin configured to be inserted into the first bore;

a second bore with a second axis;

a second pin configured to be inserted into the second bore;

an actuator including a rod, characterized in that the rod is configured to engage a work tool;

characterized in that the first pin pivotally connects the coupler to the machine linkage and work tool about the first axis;

characterized in that the second pin pivotally connects the coupler to the machine boom about the second axis; and characterized in that if the actuator rod engages the work tool, the actuator rod intersects the second axis.

10. The coupler of claim 9, further comprising a cover configured to cover at least part of the actuator.

11. The coupler of claim 9, further characterized in that the at least one actuator rod is substantially perpendicular to the second axis.

12. The coupler of claim 9, further characterized in that the actuator is a hydraulic actuator.

13. The coupler of claim 9, further characterized in that the actuator comprises two actuator rods.

14. The coupler of claim 9, further characterized in that the actuator rod comprises an engagement pin.

15. The coupler of claim 14, further characterized in that the engagement pin comprises a tapered portion configured to engage the work tool.

* * * * *